United States Patent [19]

Smilow et al.

[11] Patent Number: 4,930,692

[45] **Date of Patent: * Jun. 5, 1990**

[54] BELT HANGER

[75] Inventors: George Smilow, San Diego, Calif.; Samuel L. Kayen, Elmont, N.Y.

[73] Assignee: B&G Plastics, Inc., New York, N.Y.

[ * ] Notice: The portion of the term of this patent subsequent to Jun. 12, 2001 has been disclaimed.

[21] Appl. No.: 604,087

[22] Filed: Apr. 26, 1984

Related U.S. Application Data

[63] Continuation of Ser. No. 412,865, Aug. 30, 1982, Pat. No. 4,453,655.

[51] Int. Cl.[5] ..... A47G 25/36

[52] U.S. Cl. ..... 223/85

[58] Field of Search ..... 223/85, 87; D6/318, D6/323, 328; 211/13, 60 R, 70.6, 113; 206/480, 481; 248/339, 340, 305, 306

[56] References Cited

U.S. PATENT DOCUMENTS

| | | | |
|---|---|---|---|
| D. 146,056 | 12/1946 | Levin | D6/318 |
| D. 205,849 | 9/1966 | Magnuson | D6/323 |
| D. 206,232 | 11/1966 | Magnuson | D6/323 |
| D. 276,865 | 12/1984 | Arnold | D6/328 |
| 3,244,334 | 4/1966 | Marlar | 223/87 X |
| 3,710,996 | 1/1973 | Smilow et al. | 223/87 |
| 3,822,783 | 7/1974 | Mortensen | 206/480 |
| 4,063,669 | 12/1977 | Smilow et al. | 223/87 |
| 4,453,655 | 6/1984 | Smilow et al. | 223/87 |

FOREIGN PATENT DOCUMENTS

| | | | |
|---|---|---|---|
| 2623040 | 11/1977 | Fed. Rep. of Germany | 211/70.6 |
| 1154841 | 11/1957 | France | 211/70.6 |

*Primary Examiner*—Werner H. Schroeder

*Attorney, Agent, or Firm*—Robin, Blecker, Daley & Driscoll

[57] ABSTRACT

A hanger for display of a belt, including a buckle of type having an open frame, has a main body portion with a hook for receiving a display rod and includes a depending buckle-engaging and retaining means which is insertable within the buckle frame, is adapted for releasable retention of the buckle prong and effects full viewability of the prong free end in engagement with the buckle. The buckle is applied an exterior support surface of the buckle-engaging and retaining means and the buckle prong is then pivotally moved into retentive disposition therein.

5 Claims, 2 Drawing Sheets

BELT HANGER

CROSS-REFERENCE TO RELATED PATENT APPLICATION

This application is a continuation of application Ser. No. 06/412,865 filed Aug. 30, 1982, now U.S. Pat. No. 4,453,655 granted June 12, 1984.

FIELD OF THE INVENTION

This invention relates to hangers for belts and pertains particularly to apparatus for the display of belts of the type having buckles with a generally open frame, one course of the frame supporting a prong for pivotal movement into abutting engagement with an opposite second course of the frame.

BACKGROUND OF THE INVENTION

In prior commonly-assigned U.S Pat. No. 3,710,996 and U.S. Pat. No. 4,063,669, granted respectively on Jan. 16, 1973 and Dec. 20, 1977, a hanger for the display of belts of the type above discussed includes a plastic sheet member defining a fold line about which interlocking sections of the sheet member are folded to form an interior flat loop for containment of a course of a buckle frame. Such frame course, which may be termed the frame prong-abutting course, is supported on the hanger fold line and one or more openings are formed at the fold line to receive the prong of the buckle and retain same in engagement with the frame prong-abutting course.

Inherent performance characteristics of this belt hanger, which enjoys widespread commercial usage, include the need to assemble the buckle frame with the sheet member prior to folding of the sheet member sections and then to interlock the sheet member sections. The free end of the buckle prong, which may be of greater dimensions than the shank of the prong extending to the pivot hub of the prong, is required to enter into the retention loop opening at the fold line. It is only at this juncture that the belt may be hung for display purposes. Further, from a display viewpoint, one viewing the displayed belt does not see the appearance of the prong free end in its engagement with the frame prong-abutting course, since this is precluded by the fact that the prong free end is disposed interiorly of the retention loop. Thus, to fully view this aspect of the belt and buckle, it is necessary to open the loop.

SUMMARY OF THE INVENTION

The present invention has as its object the provision of improved hangers for belts, particularly those having open frame buckles.

A more particular object of the invention is to provide belt hangers fully assembled at the point of manufacture for direct receipt of belt buckles and from which belts may be directly removed without disassembly of the hangers.

In attaining the foregoing and other objects, the invention provides a hanger for supporting a belt for display, the belt including a buckle the of type having an open frame with one course thereof (prong-supporting course) supporting a prong for pivotal movement into engagement with a second course (prong-abutting course) of the buckle frame. The hanger includes (a) a main body portion defining a hook for receipt of a display rod; and (b) buckle-engaging means connected with the main body portion and configured (1) for insertion fully within the frame, (2) for providing an exterior surface for supporting the prong-abutting course of the frame for full viewing, (3) for receiving the buckle prong in the course of pivotal movement thereof about the prong-supporting course of the frame into registry with the prong-abutting frame course and arresting reverse pivotal movement of the prong and (4) for providing direct viewability of the free end portion of the prong while it is in engagement with the prong-abutting course of the buckle.

The foregoing and other objects and features of the invention will be further understood from the following detailed description of a preferred embodiment thereof and from the drawings wherein like reference numerals identify like parts throughout.

DESCRIPTION OF THE PREFERRED EMBODIMENT

Figure 4:
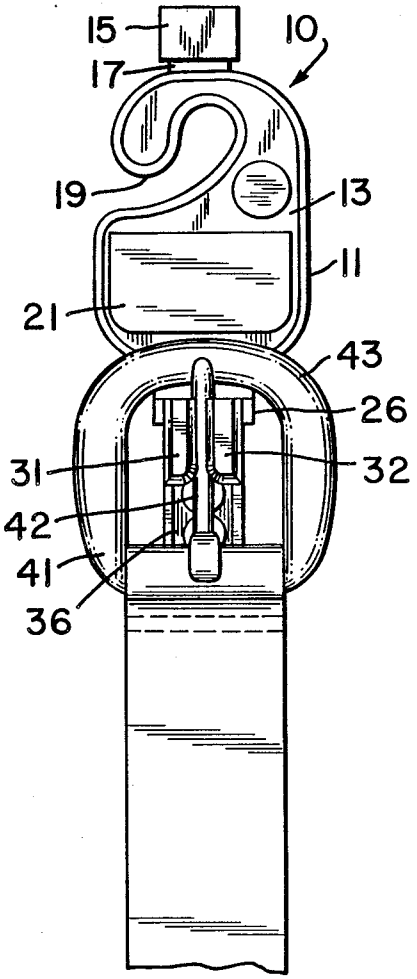
FIG. 4 is a front elevational view thereof showing the device in engaged condition with a conventional prong-type belt buckle.
Figure 3:
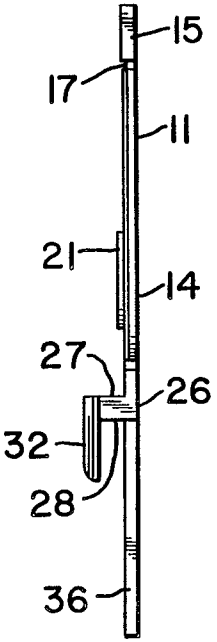
FIG. 3 is a side elevational view thereof.
Figure 2:
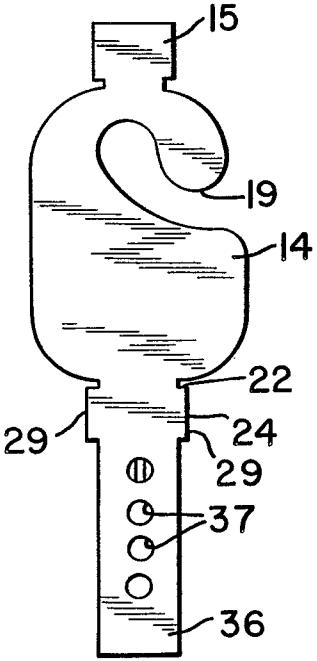
FIG. 2 is a rear elevational view thereof.
Figure 1:
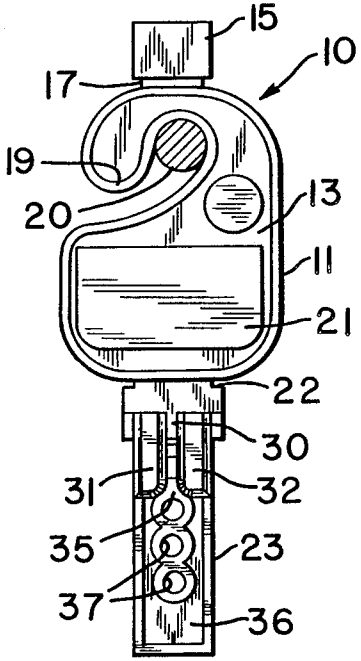
FIG. 1 is a front elevational view of an embodiment of the invention.

In accordance with the invention, the device, generally indicated by reference character 10, is preferably in the form of a single molding from synthetic resinous materials. It is bounded by a continuous peripheral edge 11, as well as first and second planar surfaces 13 and 14. An upper identification tab 15 is interconnected with a main body portion 16 by a short neck 17. The portion 16 is provided with a curvilinear slot 19, an upper edge of which is selectively engagable with a horizontally disposed supporting rod 20, as is known in the art. A raised rectangular surface 21 provides for the imprinting of additional indicia. A lower neck 22 interconnects with an elongated belt engaging element 23, an upper end 24 of which is provided with a laterally extending recess-forming member 25. The member 25 is of generally inverted L-shaped configuration, including a rectangularly shaped base portion 26 bounded by an upper surface 27, a lower surface 28, and end surfaces 29. A through channel 30 extends between the upper and lower surfaces 27 and 28. A pair of downwardly extending tab portions 31 and 32 have upper ends integrally formed with the base portion 26. The portions 31 and 32 are spaced apart to form a groove 35 overlying the channel 30. A strap portion 36 extends downwardly from the base portion 26, and is provided with a plurality of holes 37 extending over a span of approximately 1 inch.

Referring to FIG. 4, there is shown a conventional type buckle 41 having a pivotally mounted prong 42 engaged with the base portion 26, the prong being disposed within the channel 30, and detented by the groove 35. In this postion, an end member 43 of the buckle is supported on the upper surface 27.

Figure 6:
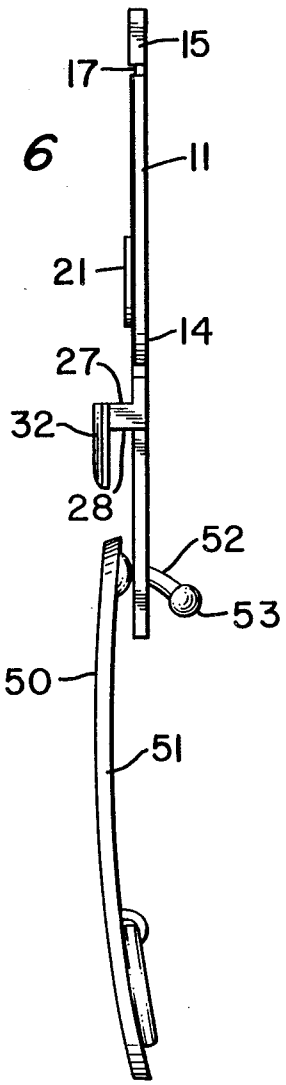
FIG. 6 is a side elevational view thereof, similar to that seen in FIG. 5, in engagement with a second type of belt buckle.
Figure 5:
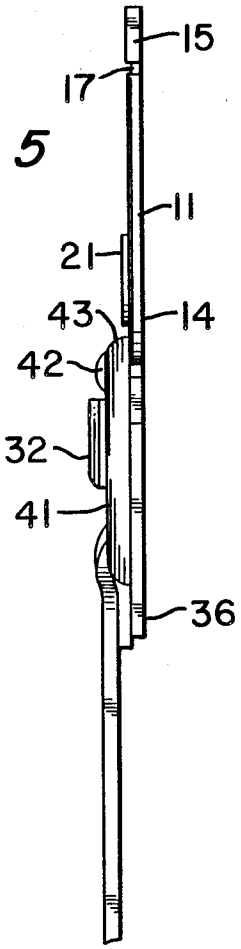
FIG. 5 is a side elevational view thereof as seen from the left-hand portion of FIG. 4.

FIG. 6 illustrates the engagement of a second type of belt buckle 50 having a relatively flat main body 51 and a rearwardly extending projection 52 with an enlargement 53 thereon. The projection 52 is engaged with any of the holes 37 to be retained by the enlargement 53.

Figure 7:
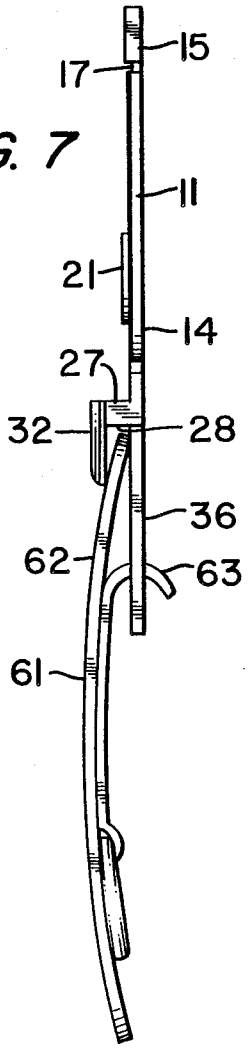
FIG. 7 is a side elevational view thereof, similar to that seen in FIG. 5, but showing a third type of belt buckle in engagement therewith.

FIG. 7 illustrates the engagement of the device with a third type of buckle 61 having a relatively flat main body 62, and a laterally extending projection 63. The projection 63 is both curved and tapered, and relies upon engagement with a hole in the belt strap upon normal tension involved in wearing the belt. Thus, a positive engagement with one of the holes 37 is not possible. This is accommodated by the fact that the downwardly extending portions 31 and 32 form a channel with the strap portion 36 in which the free edge of the body 62 may be positioned, following which the projection may be engaged with one of the holes 37, depending upon the relative location of the projection with respect to the main body.

It may thus be seen that we have invented novel and highly useful improvements in belt display hangers which provide accommodation for currently popular belt styles in that a plurality of belt buckle types may be readily accommodated for engagement without adjustment of the hanger. As is the case with prior art devices of this type, the present device may be conveniently injection molded from synthetic resinous materials at a cost sufficiently low to permit complete expendability after a single use.

Considering the hanger of FIGS. 1–7 further, the above summarized characteristics thereof will now be more clearly appreciated. Recess-forming member 25 is fully insertable within the open frame of buckle 41. Surface 27 of member 25 serves to support the prong-abutting course 43 of buckle 41 in full display to a viewer with the free end 42*a* of prong 42 in engagement with buckle course 43 and also directly viewable.

Member 25 functions in its buckle-engaging means role to receive prong 42 in the course of pivotal movement thereof on pivot hub 42*c* about the buckle prong-supporting course 45. Once retained, reverse pivotal movement of prong 42 is arrested as above noted. In still another aspect attributable to the configuration of buckle-engaging means 25, as with its illustrated dimensions, during pivotal movement of the prong, only the shank 42*b* of prong 2 resistively confronts the detent grove 35 and not the prong free end.

Also, in contrast to the hanger of the referenced '669 patent, which involves manipulative pre-hanging and belt removal steps, belts are applied directly to the hanger herein, i.e., by inserting member 25 into the open frame buckle and pivoting the prong into member 25. Release is likewise direct. Prong 42 is forcibly reversely pivoted from retention in member 25 and the belt is lifted therefrom.

Various changes may be introduced in the foregoing preferred embodiment without departing from the invention. Accordingly, it is to be understood that the particularly depicted and described showing is intended in an illustrative and not in a limiting sense. The true spirit and scope of the invention is set forth in the following claims.

We claim:

1. A hanger for supporting a belt for display, said belt including buckle of type having an open frame with one course thereof supporting a prong for pivotal movement into engagement with a second course of said buckle frame, said hanger being elongate and comprising:

(a) a main body portion defining a hook for receipt of a display rod; and (b) buckle-engaging means connected with said main body portion for receiving and releasably retaining said buckle, said buckle-engaging means having (1) length and width of dimensions suited for insertion of said buckle-engaging means in said frame, (2) an exterior surface for supporting said prong-abutting course of said frame upon such insertion in said frame, (3) a channel extending into said exterior surface for receiving said buckle prong by pivotal movement thereof about said prong-supporting course of said frame into engagement with said prong-abutting frame course while said prong-supporting course is supported on said exterior surface, said channel being configured for arresting reverse pivotal movement of said prong from such disposition in said channel, and (4) a configuration for providing direct viewability of the free end of said prong while said prong is in engagement with said prong-abutting course.

2. The hanger claimed in claim 1 wherein said buckle prong has a pivotal support hub and a shank extending from said hub to said prong free end, said buckle-engaging means including a detent groove, said shank being movable into confronting relation with said groove and forcible thereinto, said prong free end being disposed in nonconfronting relation with said detent groove throughout such pivotal movement of said buckle prong.

3. In combination:

(a) a belt including a buckle of type having an open frame with one course thereof supporting a prong for pivotal movement into engagement with a second course of said buckle frame; and (b) a hanger supporting said belt for display, said hanger comprising:

(I) a main body portion defining a hook for receipt of a display rod; and (II) buckle-engaging means connected with said main body portion and releasably retaining said buckle, said buckle-engaging means being resident in said frame, having an exterior surface supporting said prong-abutting course of said frame, being adapted for receiving said buckle prong upon such pivotal movement thereof about said prong-supporting course of said frame into engagement with said prong-abutting frame course while same is supported on said exterior surface and arresting reverse pivotal movement of said prong and providing direct viewability of the free end of said prong while in engagement with said prong-abutting frame course.

4. A display hanger for belts having varying types of belt buckles at one end thereof comprising: a unitary piece of synthetic resinous material including a main body having hook means for engaging a supporting rod, and a depending buckle-engaging element connected to said main body; said buckle-engaging including an elongated portion adjacent said main body portion having at least one opening therein extending through the plane thereof and a laterally extending recess forming member having an upper surface and supported by said elongated portion and including a base defining an axially oriented expandable slot therein, said slot being adapted to engage the pivotally mounted centrally disposed prong of a belt buckle while said buckle is supported from said upper surface of said recess forming member; and a pair of downwardly extending tabs secured at the upper ends thereof to said recess forming member on either side of said slot, and at least partially over-lying at least one opening in said elongated portion to define a channel into which a buckle having a laterally extending projection thereon may be inserted, said projection engaging said at least one opening.

5. A hanger in accordance with claim 1, further characterized in the provision of a plurality of openings in said elongated portion to accommodate for differing relative locations of said laterally extending projection relative to said belt buckle.

* * * * *